US006497570B1

(12) United States Patent
Sears et al.

(10) Patent No.: US 6,497,570 B1
(45) Date of Patent: Dec. 24, 2002

(54) GAS CONTROL ASSEMBLY

(75) Inventors: Merle Dana Sears, Mooresville, IN (US); Rex Russell Mills, Indianapolis, IN (US); Ninev Karl Zia, Indianapolis, IN (US); William Bruce Sutherlin, Indianapolis, IN (US); Stephen Leon Pulley, Carmel, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/981,479

(22) Filed: Oct. 17, 2001

(51) Int. Cl.[7] ..... F24H 3/02; F23C 5/08

(52) U.S. Cl. ..... 431/178; 126/99 R; 126/110 R; 431/343

(58) Field of Search ..... 126/110 R, 99 R, 126/116 R, 114, 116 B, 106, 109; 431/343, 178

(56) References Cited

U.S. PATENT DOCUMENTS 5,094,224 A * 3/1992 Diesch ..... 126/99 R
5,379,750 A * 1/1995 Larsen et al. ..... 126/110 R
5,392,761 A * 2/1995 Swilik, Jr. et al. ..... 126/99 R
5,406,933 A * 4/1995 Lu ..... 126/110 R
5,647,742 A * 7/1997 Sears et al. ..... 432/247
5,799,646 A * 9/1998 Zia et al. ..... 126/110 R

* cited by examiner

*Primary Examiner*—James C. Yeung
(74) *Attorney, Agent, or Firm*—Wall Marjama & Bilinski LLP

(57) ABSTRACT

A gas control assembly for a forced air furnace which includes a support frame having a top surface and two contiguous side walls which define an enclosure. A planar one piece burner assembly which has a plurality of burners and having two opposite side edges with one edge containing indexing means is positioning in a predetermined location within the enclosure of the support frame. A elongated gas manifold having a closed end and an open end which is configured to mate with the burner assembly to provide a source of combustible fuel to each of said burners is connected in fixed engagement to the support frame at its closed end through a hole in one side of said support frame and by a bracket at the open end which is attached to the other side of said support frame. The side walls of the support frame also contain slots which mate with edges of the burner assembly to provide for proper alignment of the burner assembly.

8 Claims, 5 Drawing Sheets

GAS CONTROL ASSEMBLY

BACKGROUND OF THE INVENTION

The present invention is directed to a furnace that provides heated circulation air to an interior comfort space. More particularly the invention is directed to a gas control assembly for a forced air furnace that eliminates extra parts and provides for improved burner alignment and fitup.

Unless certain design features are provided, burners can be incorrectly installed upside down or backward. In addition, when burners are individually installed, the alignment of burner becomes a concern along with the requirement for an additional support for the individual burners. Many conventional burner support structures for forced air furnaces do not effectively function to shield flames from stray air currents and require multiple screws and intermediate parts. Furthermore, these conventional prior art support structures do not provide for design features which assure accurate burner alignment or prevent misassembly. Generally conventional support structures while requiring extra parts and fasteners, result in a continuing problem with respect to burner alignment and assembly.

It can therefore be seen that there is a continuing need in the field for a simple design which will provide for accurate burner alignment and assembly and which reduce the number of parts for the gas control assembly.

SUMMARY OF THE INVENTION

It is therefore an objective of the present invention to provide for a gas control assembly which provides for improved burner alignment.

It is another objective of the present invention to provide for a burner support structure which assures accurate burner assembly.

It is a further objective of the present invention to provide a gas control assembly which can be easily assembled with a minimum of parts and fasteners.

The present invention is directed to a gas control assembly that provides for improved alignment for the burners and reduces the number of required parts for the complete assembly.

The complete assembly includes a rigid support frame, a ganged burner assembly and a manifold which is connected to a gas valve. The support frame has three continuous surfaces, roughly in the form of an inverted "U" which form a space in which to mount the burners. Ovals or equivalent means are embossed in the sides of the support which function to prevent the burners from being misaligned. Round protrusions or dimples of differing lengths are also included in the side walls and prevent the burners from being installed upside down or backward. When matched to an indexing notch in the ganged burner assembly, the burners and manifold will properly fit together. If the notch and a slot in the dimple are mismatched, the manifold will not fit into the support.

A punched and flared hole is also provided in one side of the support and the sheared edge with screw lances provide a tight tolerance by which to locate the manifold while requiring only two screws to hold the entire assembly together. The lances provide improved manifold alignment since the mounting holes are not subject to additional tolerance stack up present when using holes in bent flanges.

The ganged burner assembly provides the advantage of fewer parts to handle, and eliminates any alignment problems between burners. This design also eliminates additional support which would be required for individual burners. The burners assembly also contains an integrated flame sensor bracket and igniter bracket attachment. Incorporating these brackets into the burner assembly eliminates extra parts and fasteners while providing improving alignment and fitup.

BRIEF DESCRIPTION OF THE DRAWINGS

For a further understanding of these and objects of the invention, reference will be made to the following detailed description of the invention which is to be read in connection with the accompanying drawings, wherein.

DETAILED DESCRIPTION OF THE INVENTION

Figure 1:
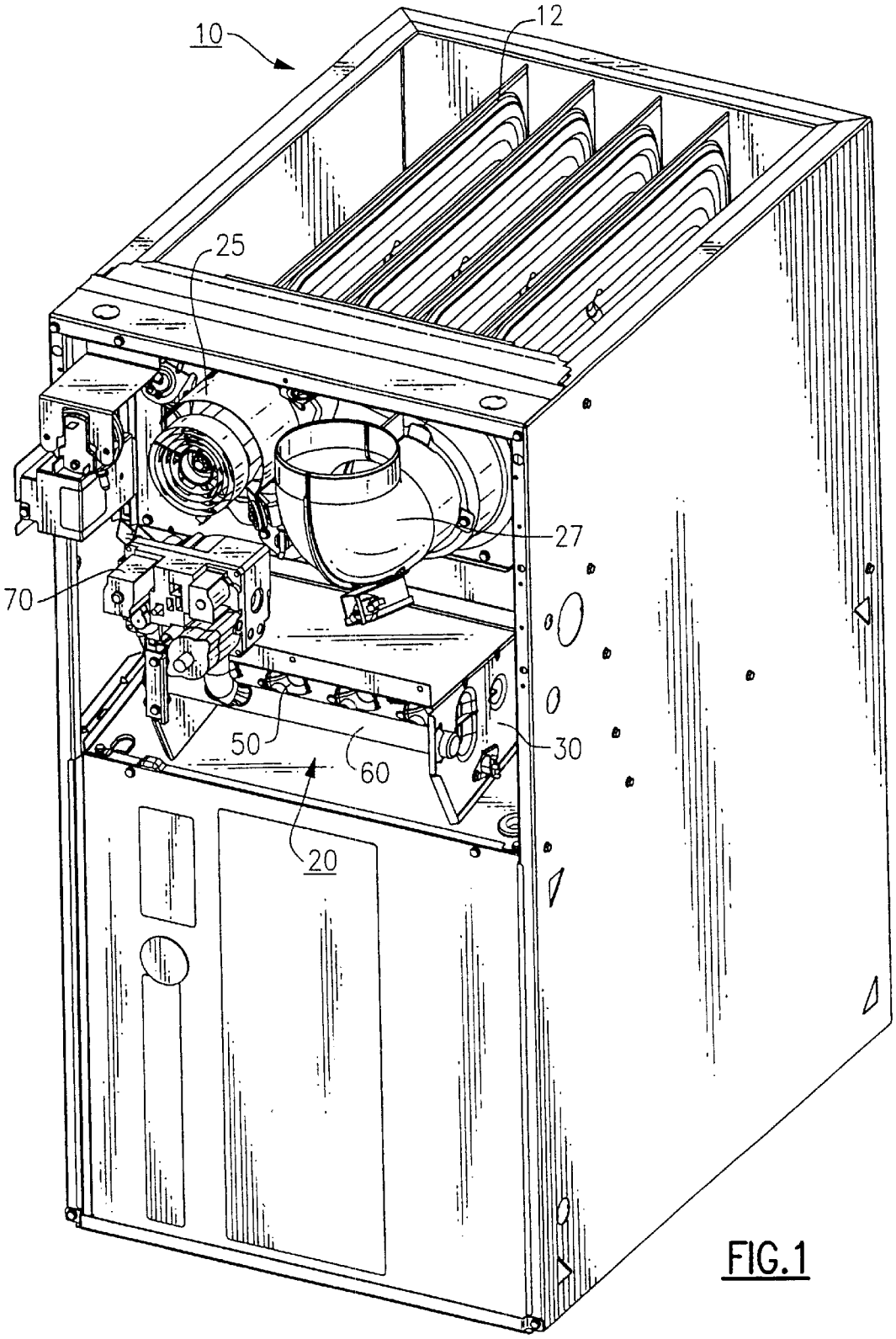
FIG. 1 is a perspective view of a furnace with the front panel removed to illustrate the key components of the present invention.

Turning now to the drawings and particularly, FIG. 1, the major operational components of a typical forced air furnace, denoted as 10, are generally shown. The primary heat exchanger 12 in this case is made up of a number of individual heat exchange panels. A return air fan or blower (not shown) is positioned at the bottom of the furnace cabinet below the heat exchanger and forces return air drawn from a comfort zone through a return air duct (not shown), whereby the return air is passed over the heat transfer surface of the heat exchanger. The gas flow assembly 20 is attached to the front of the furnace in front of the entry ports (not shown) to each of the parallel panels. A burner assembly 50 held in support frame 30 contains a separate burner for servicing each panel is adapted to inject high temperature flue gas products directly into the entrance of an associated heat exchange panel. A manifold 60 supplies a source of fuel to the burner assembly from gas valve 70.

An inducer unit 25 is operatively attached to the front of the furnace. The inducer functions to pull flue gas products through the heat exchanger and discharge the products out of the furnace through flue 27. The supply air passing through the duct is forced over the heat transfer surfaces of each heat exchange panel.

The gas control assembly of the present invention comprises a combination of the support frame, ganged burner assembly, manifold and associated gas valve. This assembly is shown in greater detail in FIGS. 2, 3 and 4 of the drawings. Except for the gas control assembly of the present invention, the furnace in which it is used is a conventional forced air furnace as illustrated in FIG. 1. The basic components and operation of such a furnace are shown in greater detail in U.S. Pat. Nos. 5,647,742 and 5,392,761 which are incorporated herein by reference.

Figure 2:
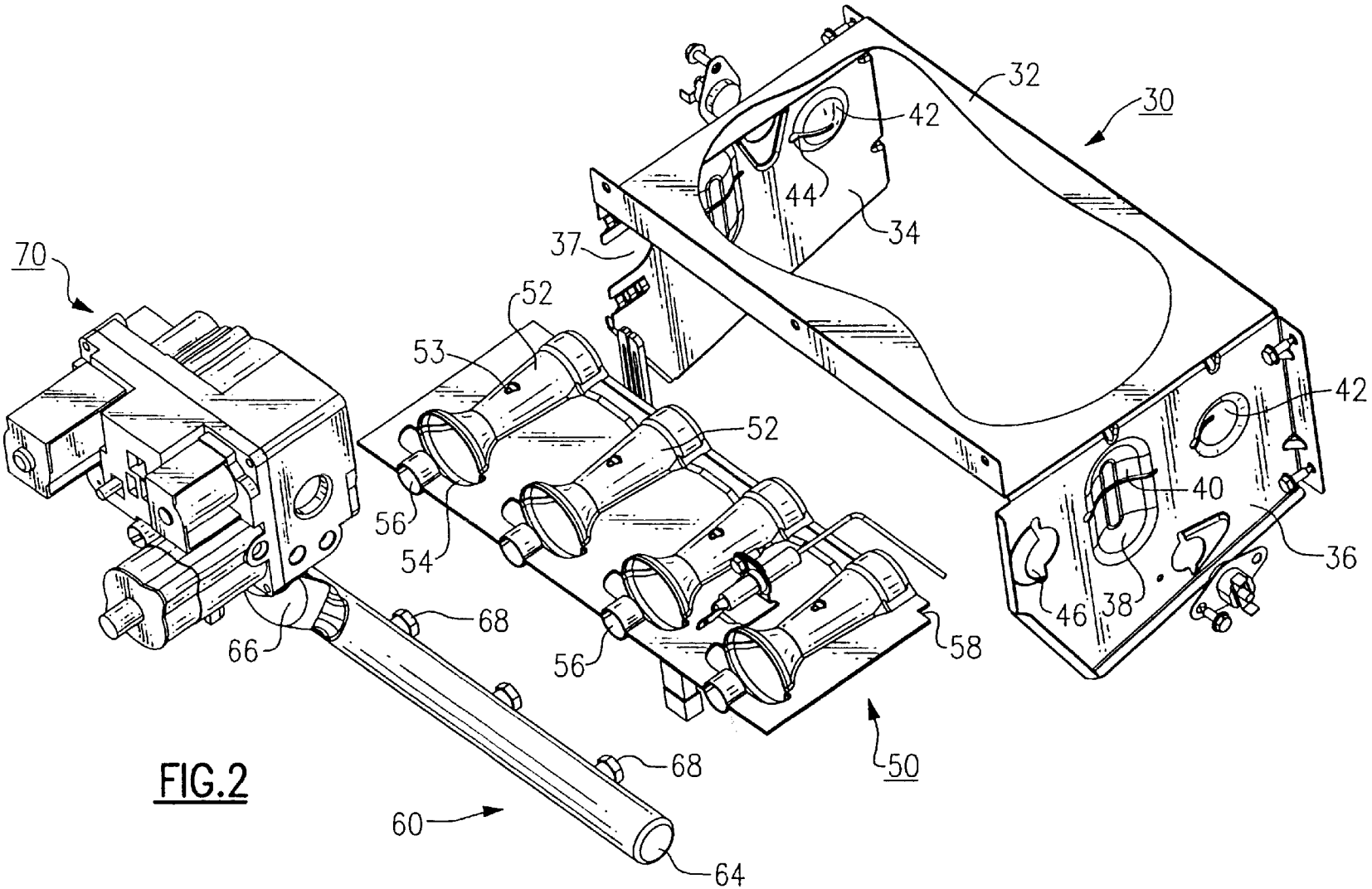
FIG. 2 is an exploded perspective view of the burner assembly of the present invention.
Figure 3:
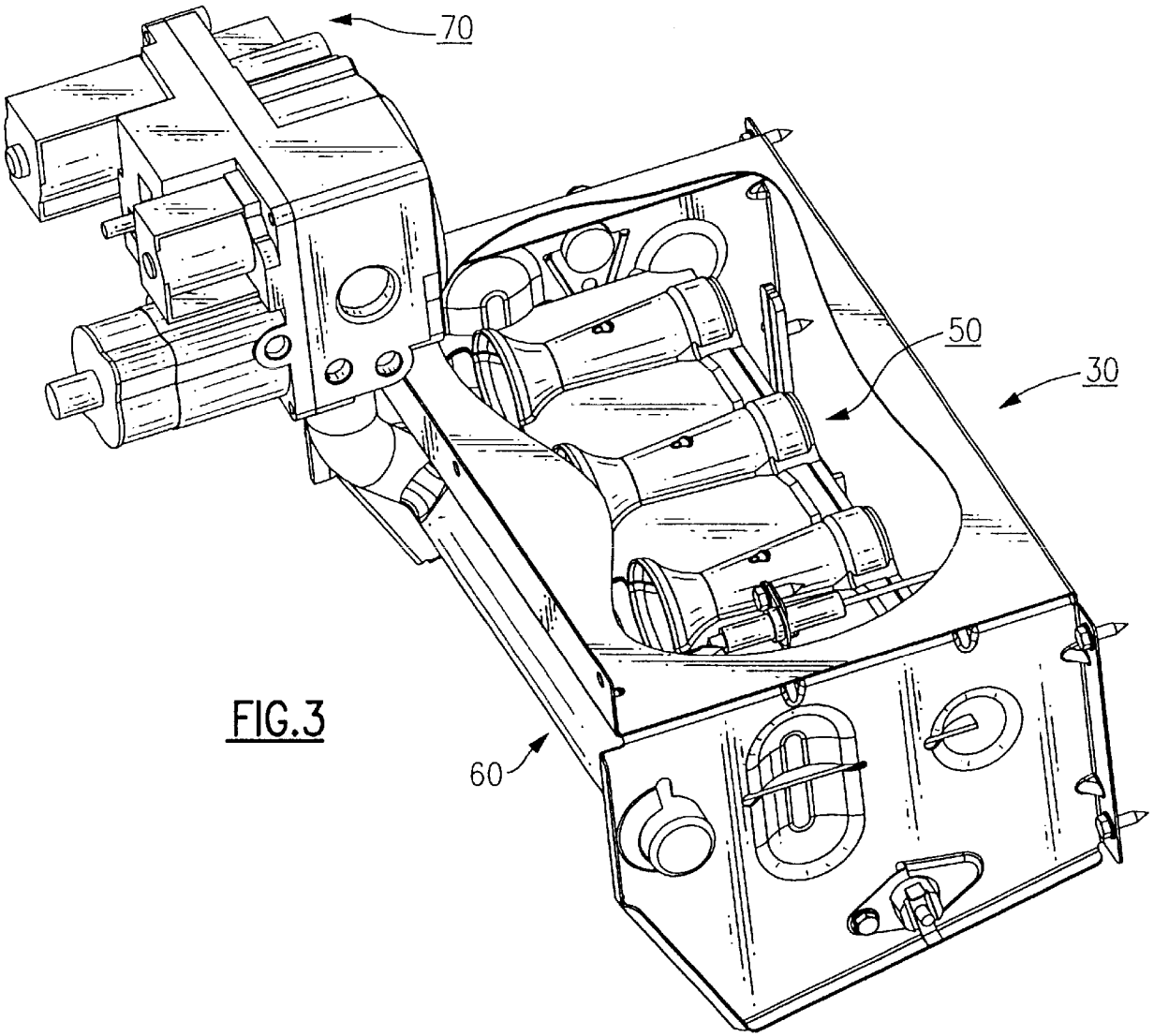
FIG. 3 illustrates the components of FIG. 2 in the form of an assembled burner assembly.
Figure 4:
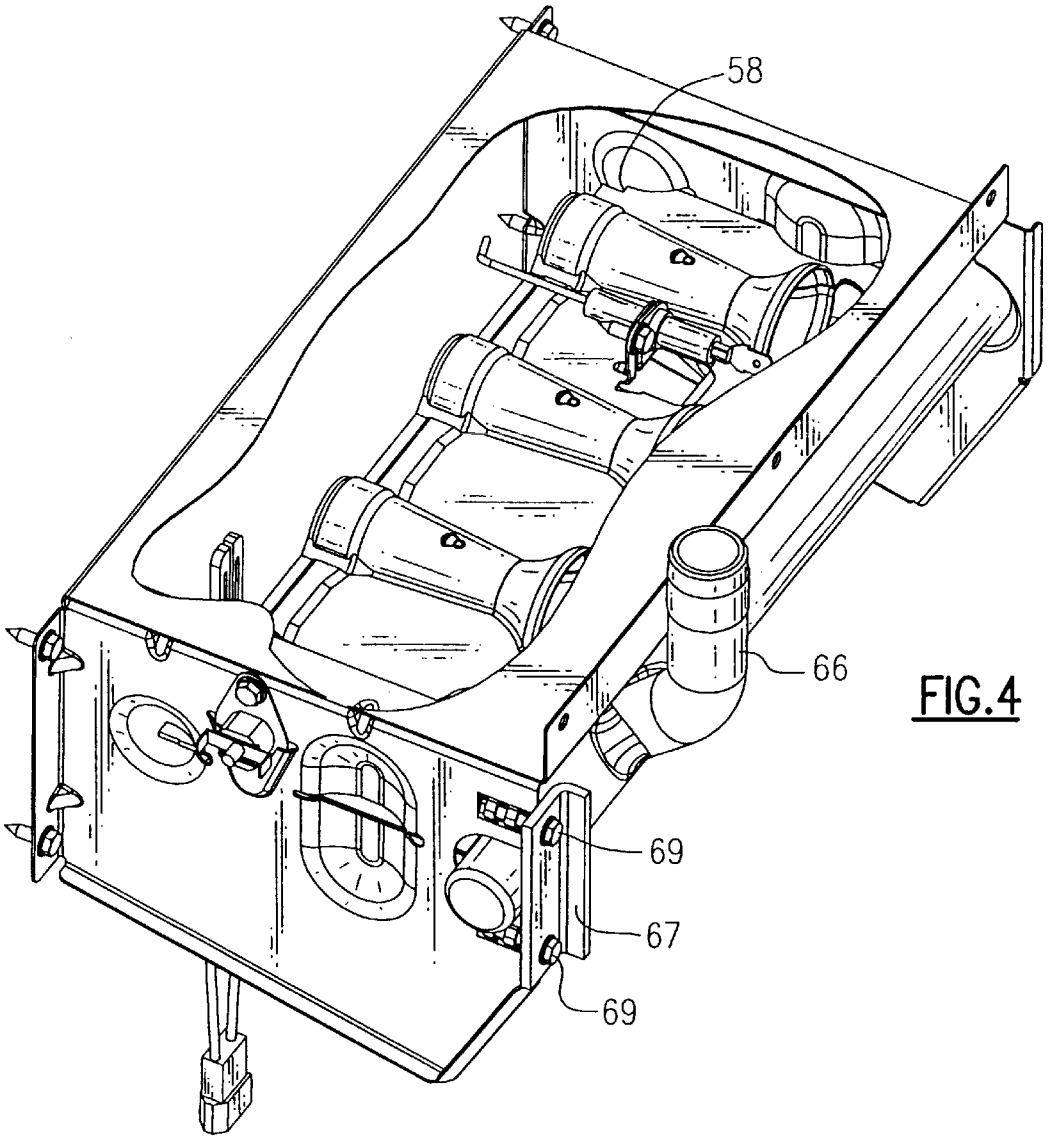
FIG. 4 is a view of the opposite side of the assembly of FIG. 3 with the gas valve removed.

Referring to FIG. 2, the gas control assembly 20 comprises support frame 30, ganged burner assembly 50, manifold 60 and gas valve 70. The support frame includes a top 32 and integral side walls 34 and 36. Ovals 38 are embossed in the sides of the support and contain a slot 40 which mates with the side edge of the burner assembly to hold the assembly in place while dimple 42 and slot 44 function to index and properly position the burner assembly within the support. A burner assembly 50 is the unitized planer structure which contains a plurality of burners 52 which include an elongated mixer tube 53having a flared mixer face 54 and burner ports 55. Orifice holders 56 are adapted to be connected to the corresponding orifice spud 68 contained on the manifold. A notch 58 on the right hand corner of the burner assembly is cut to match with the slot location of the dimple 42 to ensure proper alinement to prevent the burner assembly from being installed upside down or backwards. Round protrusions or dimples 42 on the side walls are positioned at different lengths from the front edge of the side walls to ensure that dimple 42 and associated slot 44 on the right side match with notch 58. In the embodiment illustrated the dimple on the right side is about ¼ inch closer to the outside edge of side wall 36 then the dimple in side wall 34. A punched and flared hole 46 is formed in the right side of the support frame to position and hold the closed end 64 of manifold 60 in place once the burner assembly has been inserted in the support frame. See FIGS. 3 and 4. The T-end 66 of the manifold 60 which is connected to the gas valve 70 fits in slot 37 of the support and the assembly is then held in place by bracket 67 requiring only two screws 69 as illustrated in FIG. 4 of the drawings.

Figure 5:
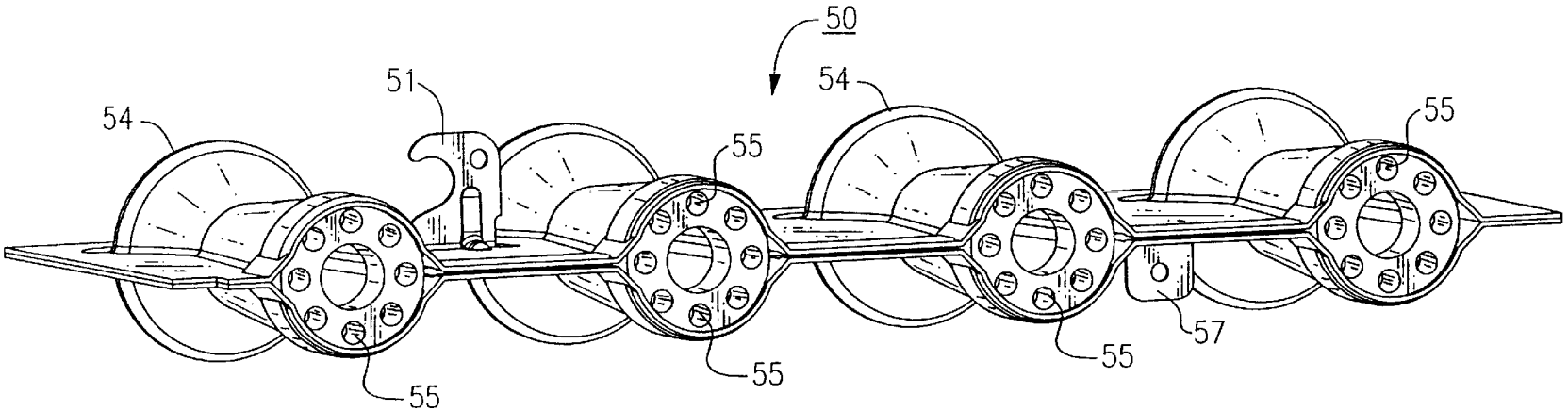
FIG. 5 is a perspective rear view of the ganged burner assembly.

FIG. 5 is a perspective view of the rear portion of the ganged burner assembly showing burner ports 55 and the flame sensor bracket 51 and ignitor bracket mounting 57 in greater detail.

It can be seen from the above, structure of the present assembly provides for secure and proper burner alignment, and only requires two screws to properly assembly the entire gas control assembly.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A gas control assembly for a forced air furnace which comprises in combination:

(a) a support frame having a top surface and two contiguous side walls which define an enclosure, (b) a planar one piece burner assembly having two opposite side edges with one of said edges containing indexing means for positioning said assembly in a predetermined location within the enclosure of said support frame, (c) an elongated gas manifold having a closed end and an open end and which is configured to mate with said burner assembly to provide a source of combustible fuel to each of said burners with said manifold being connected in fixed engagement to said support at its closed end through a hole in one side of said support frame and by a bracket at its open end which is attached to the other side of said support frame.

2. The assembly of claim 1 in which the side walls of said support frame contain slots which mate with edges of the burner assembly to provide for proper alignment of said burner assembly.

3. The assembly of claim 1 in which the indexing means comprise a notch at one corner of the burner assembly which is positioned to index with stop means contained on one inside wall of said support frame.

4. The assembly of claim 1 in which the burner assembly further includes an integral flame sensor bracket and an ignitor bracket mounting.

5. A gas control assembly for a forced air furnace which functions to effectively shield flames from stray currents and provides for accurate burner alignment which comprises in combination:

(a) a support frame having a top surface and two contiguous side walls which define an enclosure with said side walls each containing a horizontal slot, (b) a planar one piece burner assembly having two opposite side edges with one of said edges containing indexing means for positioning said assembly in a predetermined location within the enclosure of said support frame, with said side edges being adapted to mate in the slots of the side walls of said support frame, (c) an elongated gas manifold having a closed end and an open end which is configured to mate with said burner assembly to provide a source of combustible fuel to each of said burners with said manifold being connected in fixed engagement to said support at its closed end through a hole in one side of said support frame and by a bracket at its open end which is attached to the other side of said support frame.

6. The assembly of claim 5 in which the indexing means comprise a notch at one corner of the burner assembly which is positioned to index with stop means contained on one inside wall of said support frame.

7. A gas control assembly for a forced air furnace which comprises in combination:

(a) a support frame which includes two oppositely disposed side walls which define a space therebetween, (b) a planar one piece burner assembly having two opposite side edges with one of said edges containing indexing means for positioning said assembly in a predetermined location in said space between said side walls of said support frame, (c) an elongated gas manifold having a closed end and an open end and which is configured to mate with said burner assembly to provide a source of combustible fuel to each of said burners with said manifold being connected in fixed engagement to said support at its closed end through a hole in one side wall of said support frame and by a bracket at its open end which is attached to the other side wall of said support frame.

8. The assembly of claim 7 in which the side walls of said support frame contain slots which mate with edges of the burner assembly to provide for proper alignment of said burner assembly.

* * * * *